US005476376A

United States Patent [19]

Santhouse et al.

[11] Patent Number: 5,476,376

[45] Date of Patent: Dec. 19, 1995

[54] CATALYTIC BURNER AND REGULATION SYSTEM THEREFOR

[75] Inventors: Daniel Santhouse, Wilton; H. Roy Taylor, Stratford, both of Conn.

[73] Assignee: Conair Corporation, Stamford, Conn.

[21] Appl. No.: 251,094

[22] Filed: May 31, 1994

[51] Int. Cl.[6] ..... F23A 14/28

[52] U.S. Cl. ..... 431/344; 431/255; 137/505.25; 126/406; 126/409

[58] Field of Search ..... 431/344, 354, 431/345, 255; 126/406, 412, 409, 408, 414; 137/495, 505.14, 505.25

[56] References Cited

U.S. PATENT DOCUMENTS

| | | | |
|---|---|---|---|
| 158,389 | 1/1875 | Parsons | 137/505.25 |
| 921,272 | 5/1909 | McCarthy | 137/505.25 |
| 2,281,417 | 4/1942 | Darby | 137/495 X |
| 4,815,441 | 3/1989 | Schawbel et al. | 431/344 X |
| 4,932,393 | 6/1990 | Sim | 431/344 X |

FOREIGN PATENT DOCUMENTS

| | | | |
|---|---|---|---|
| 223646 | 9/1942 | France | 137/505.25 |

*Primary Examiner*—Carl D. Price
*Attorney, Agent, or Firm*—Haynes N. Johnson

[57] ABSTRACT

A butane burner for personal care appliances includes a receptacle at one end for a gas canister. Upon insertion of a canister, a probe presses against the canister valve, opening it; and it thereafter remains open. Gas then flows to the input end of the control stem and, depending upon the longitudinal positioning of the control stem, flows into the stem through a gas inlet orifice in one side of the stem and travels in a channel within the stem to an outlet orifice at the other end. There it enters a Venturi, is mixed with air, passes from there through a mixing chamber and to a burning chamber within the barrel of the curling iron. The catalytic burner is located in the burning chamber. The control stem is spring-pressed in a direction to keep the gas inlet orifice normally in the open position. Movement of the control stem a slight distance in a direction away from the canister and toward the Venturi blocks the gas inlet orifice and stops gas flow. This movement can be caused by movement of a shut-off cam, or by the action of a pressure regulator.

14 Claims, 4 Drawing Sheets

CATALYTIC BURNER AND REGULATION SYSTEM THEREFOR

FIELD OF THE INVENTION

This invention relates to the field of catalytic burners of a type which can be used for heating personal care appliances, such as curling irons. The catalytic burner uses a gas, such as butane, and combusts it catalytically. In particular, this invention relates to the gas flow system in the burner and to regulation of the gas pressure.

BACKGROUND OF THE INVENTION

Most systems for regulating gas pressure in catalytic burners involve the seating and unseating of a valve seat located at the mouth of a canister containing the gas. When the valve seat is moved from the opening, gas flows around it and into the system. This is often difficult to regulate precisely and can involve the use of many parts.

The present system, by contrast, has no valve seat as such, but has a valve stem through which the gas flows.

BRIEF SUMMARY OF THE INVENTION

The burner of this invention will be described with reference to its use in a curling iron.

The burner includes a receptacle at one end of the curling iron for a gas canister. Upon insertion of the canister, a probe presses against the canister valve, opening it; and it thereafter remains open. Gas then flows to the input end of a control stem and, depending upon the longitudinal positioning of the control stem, flows into the stem through a gas inlet orifice in one side of the stem and travels in a channel within the stem to an outlet orifice at the other end. There it enters a Venturi, is mixed with air, passes from there through a mixing chamber and to a burning chamber within the barrel of the curling iron. The catalytic burner is located in the burning chamber. The control stem is spring-pressed in a direction to keep the gas inlet orifice normally in the open position.

Movement of the control stem a slight distance in a direction away from the canister and toward the Venturi blocks the gas inlet orifice and stops gas flow. This movement can be caused by use of a shut-off cam, or by the action of a pressure regulator.

The pressure regulator has a flexible pressure-regulating diaphragm surrounding, and sealed to, the stem and extending to a sealed contact with the walls of a regulator body (central body). Gas from within the stem channel passes from the channel through a pressure-regulating orifice to the canister side of the diaphragm, pressing against it, and, so, opposing the stem spring. If the pressure becomes sufficiently great, the stem will be moved against the spring, serving to close the gas inlet orifice, thus shutting off gas flow. This reverses itself, opening the orifice again, once the pressure has dropped as a result of burning of gas.

A piezoelectric crystal, mounted at the outer end of the barrel, is used as an igniter for the catalytic burner. It has a central igniter electrode running from the crystal to the burner; and its second electrode is a circuit running from crystal through the curling iron barrel (metal) and connected to the burner frame.

A bimetallic disk is positioned over holes leading from the mixing chamber to the combustion chamber to act as a temperature regulator. It serves close those holes when the unit reaches the maximum desired temperature. Most of the air-gas mixture, which is continuing to flow, then bleeds out to the atmosphere.

DETAILED DESCRIPTION OF THE INVENTION

Introduction

Figure 1:
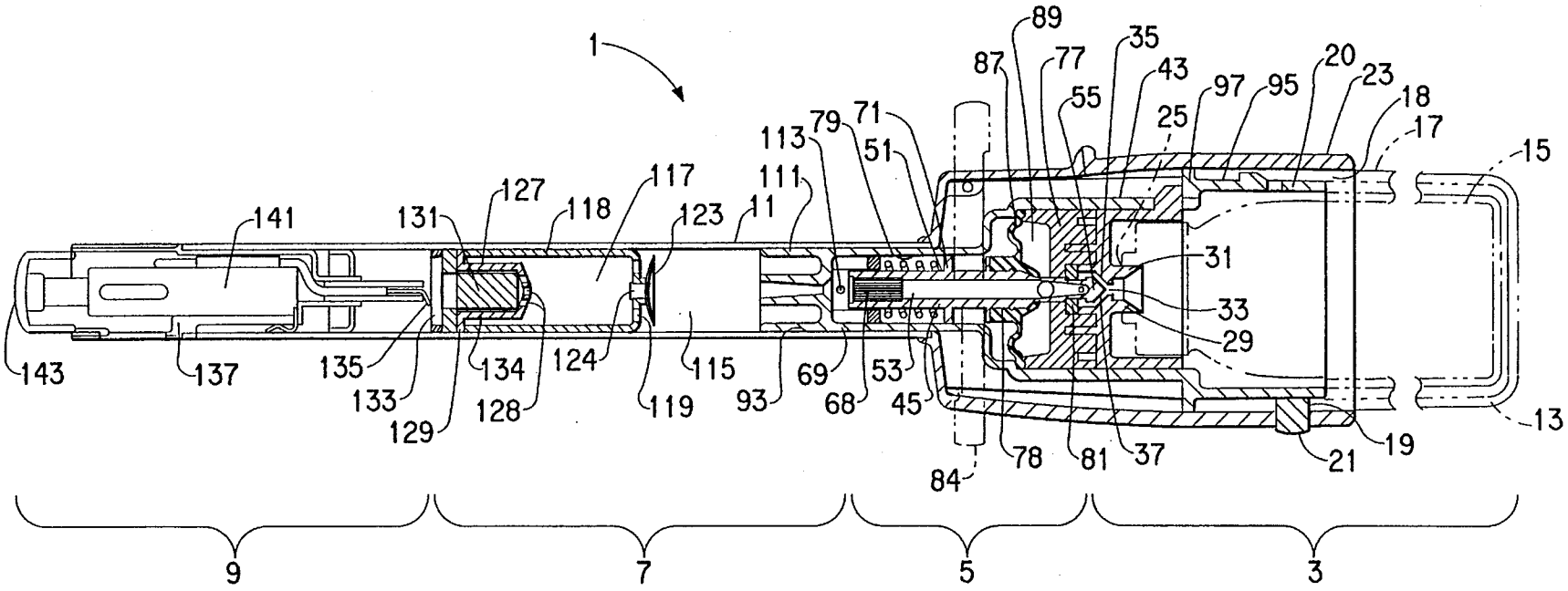
FIG. 1 is a longitudinal transverse section through the entire burner of this invention.

Catalytic burner 1 is made up of several interrelated sections (FIG. 1): a fuel supply section 3, a control section 5, a mixing and burning section 7, and an ignition section 9. Though it can be used for many purposes, it will be described in connection with one use, heating a curling iron. Thus, it includes a metal curling iron barrel 11, a casing 13, and a cover 17 for a gas canister 15. The cover forms an extension of the casing and is used as a handle.

When a canister of gas is installed in the burner, the valve on the canister is opened by a probe 31 and remains open until the canister is removed. Fuel flow is from the canister into a central longitudinal channel 53 in a control stem 45, out an outlet orifice 69 at the other end of the control stem 45, through a Venturi 111 for mixture with air, and then into the catalytic burner 127. Control mechanisms serve to control pressure and temperature.

Pressure is centralled by the position of control stem 45 which moves longitudinally. The extent of its motion is limited by seats 57 and 65 on it which engage with rubber valve seat 81. The stem is spring pressed toward the canister, which is the open position.

The Fuel Supply Section

The fuel supply section serves to supply the gas to be burned, normally butane. The gas is contained, under pressure, in canister 15 which is held in place by cover 17. Cover 17 fits within slot 18 formed by the rear edge 23 (of the outer casing 13) and a rearwardly extending flange 20, just inside the rear edge of the outer casing 13. Flange 20 is part of central body 43, described below. The cover 17 is held in place by slot 19 (on the cover) which fits about outwardly-extending pin 21 on the central body 43.

Canister 15 has a spring-pressed valve 25 of the usual type. The central body 43 carries valve member 29, which includes a probe 31 with an internal channel 33. When the canister 15 is in position within cover 17, probe 31 presses against valve 25, opening it so that gas flows through channel 33. Valve 25 is held in the open position by probe 31 for the entire time that the canister is in place, permitting gas to flow through channel 33. Gas flow thereafter is controled by slight longitudinal motion of control stem 45. It is "on" when stem 45 is in its position closest to the canister (FIG. 2); it is "off" when stem 45 is in its position farthest removed from the canister (FIG. 3). The motion of the control stem 45 is limited by seat 57 contacting rubber valve seat 81. Control stem 45 is spring-pressed by spring 70 to the "on" position. Thus, a force must be exerted on stem 45 to turn the burner off.

The outlet end of channel 33 is formed as a recess 35. The end of the longitudinally movable control stem 45 closest to the canister, that is, end socket 55, fits within recess 35, forming gas channel 37 between end socket 35 and the walls of recess 35. The stem and its end socket 55, however, are constrained from moving in the direction of channel 33 far enough to actually close the channel. Thus, gas channel 37 is always open, permitting the flow of gas from the canister to the channel.

Figure 2:
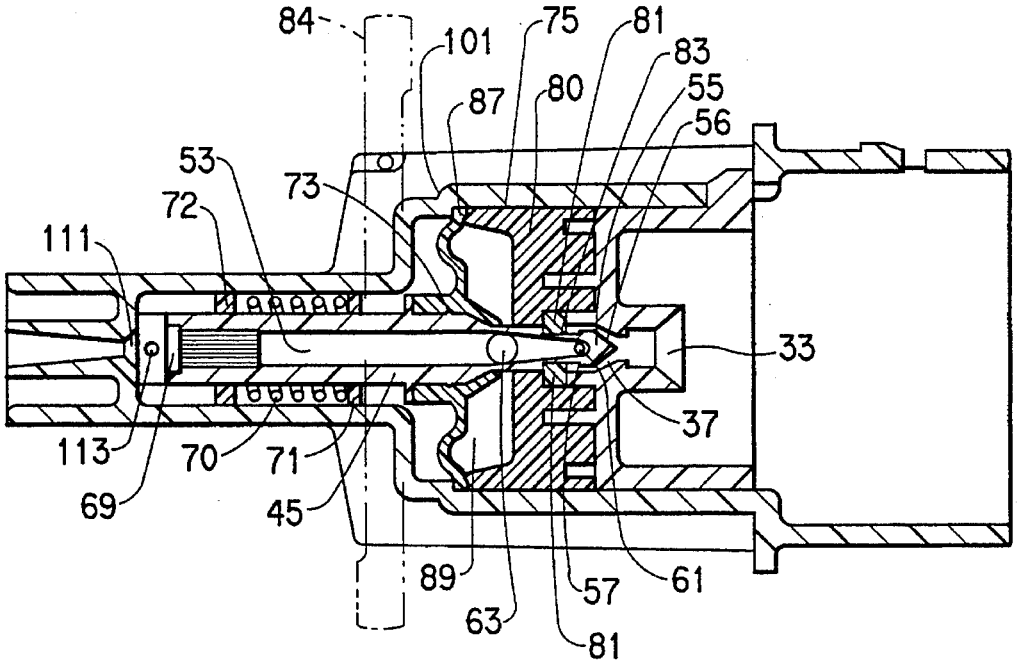
FIG. 2 is an enlarged portion of the section of FIG. 1, showing the control stem in the position which results in gas flowing through the unit.
Figure 3:
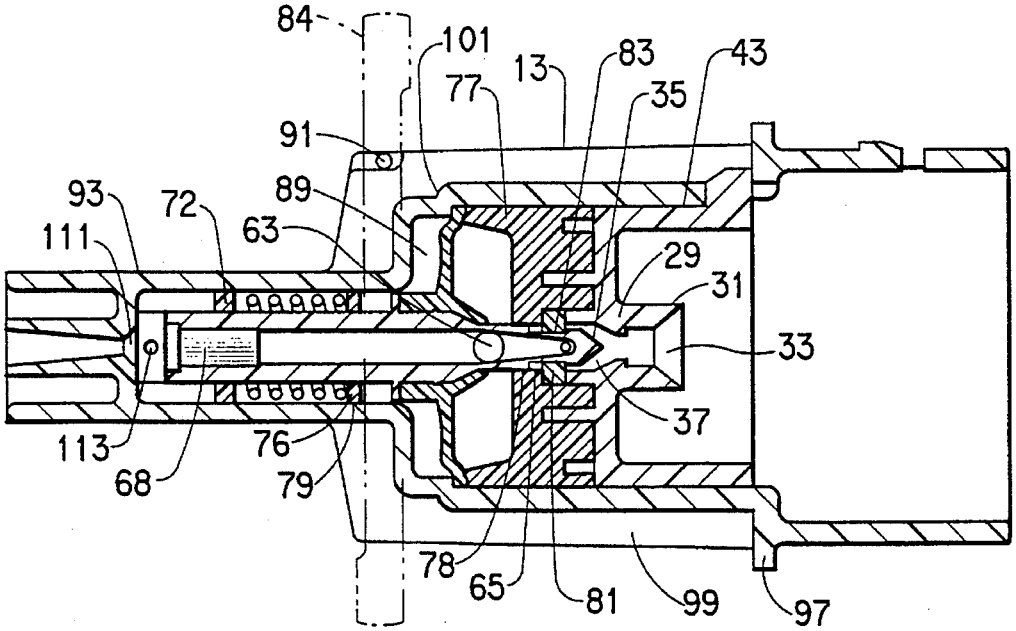
FIG. 3 is similar to FIG. 2, but with the control stem in the position which results in gas not flowing through the unit. It will be in this position either when the unit is turned off or when the pressure regulator has caused a temporary disruption of gas flow.

It can be seen, however, by comparing FIGS. 2 and 3, that gas can enter inlet orifice 61 only when control stem 45 is in its position closest to the canister. If it is in its position removed from the canister (FIG. 3), inlet orifice 61 is within hole 83 in valve seat 81, and the seat 57 presses against the valve seat 81 forming a seal. This prevents flow to gas inlet orifice 61.

The Control Section

Figure 4:
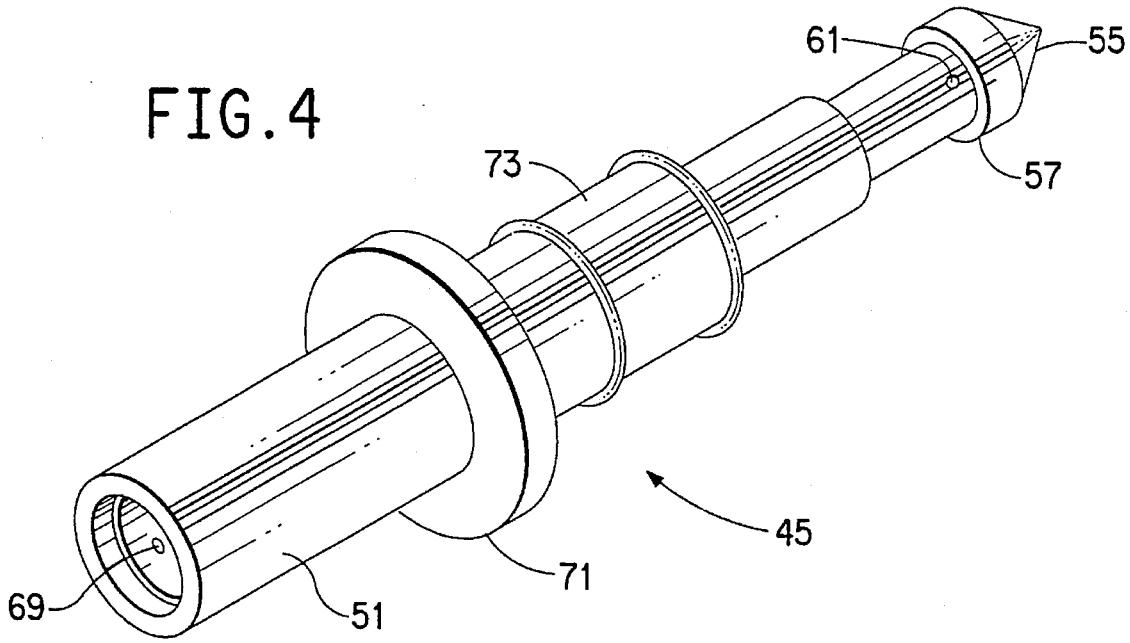
FIG. 4 is a perspective view of the control stem itself.

Control stem 45 (FIG. 4) has a generally tubular body 51 with an internal longitudinal channel 53 which runs from its gas inlet orifice 61 (near the canister end) to gas outlet orifice 69 at the other end. Inlet orifice 61 runs transversely into control stem 45, beginning behind end socket 55, proximate to seat 57. Gas flows from the canister to gas channel 37 which carries it around end socket 55 and into gas inlet orifice 61. A filter 68 is positioned within channel 53 proximate to outlet orifice 69.

Control stem 45 is mounted within central body 43 for axial movement. It is held by alignment members 76 on the stem which slidingly contact the inner surface 79 of central body 43, and by the bearing opening 78 in stem support 77. The extent of its axial movement is limited, as stated above, by seats 57 and 65 pressing against valve seat 81.

The control stem 45 is spring-pressed toward the canister by spring 70 which fits against seat 71 on the stem and seat 72 on the central body.

This latter feature results from the use of a differential pressure valve. This valve is formed by flexible diaphragm 87 which is sealed to diaphragm seat 73 on the control stem and diaphragm seat 75 on the inner surface 79 of the central body 43. The tightness of the latter seal is assured by fitting the outer rim 88 of the diaphragm between a shoulder 101 on the central body and the outer rim 80 of stem support 77.

The diaphragm 87 and the stem support 77 form a pressure control plenum 89, through which control stem 45 passes. Channel 53 of the control stem is connected to the plenum by pressure control orifice 63. Thus, the gas pressure in channel 53 enters the plenum and presses against the diaphragm, tending to push the control stem in a direction away from the canister. This pressure is opposed by the force of spring 70, so that, under normal conditions, the control stem does not move. In the event, however, that the gas pressure becomes too great, i.e., greater that the opposing force, the control stem will move in a direction away from the canister. This will cause seat 57 end socket 55 to seal and prevent any further gas from being delivered to gas inlet orifice 61. The pressure in plenum 89, allowing the control stem to move toward the canister, and starting gas flow again.

This same movement of the control stem 45 is used to turn the unit off and on. A cam forces the stem in a direction away from the canister when one wishes to shut off the unit; and releases it when it is to be turned on.

Thus, as can be seen, control stem 45 serves a variety of functions. Except for the diaphragm 87 and spring 70, it is essentially the only moving part, reducing the cost of manufacture.

The Central Body

Figure 5:
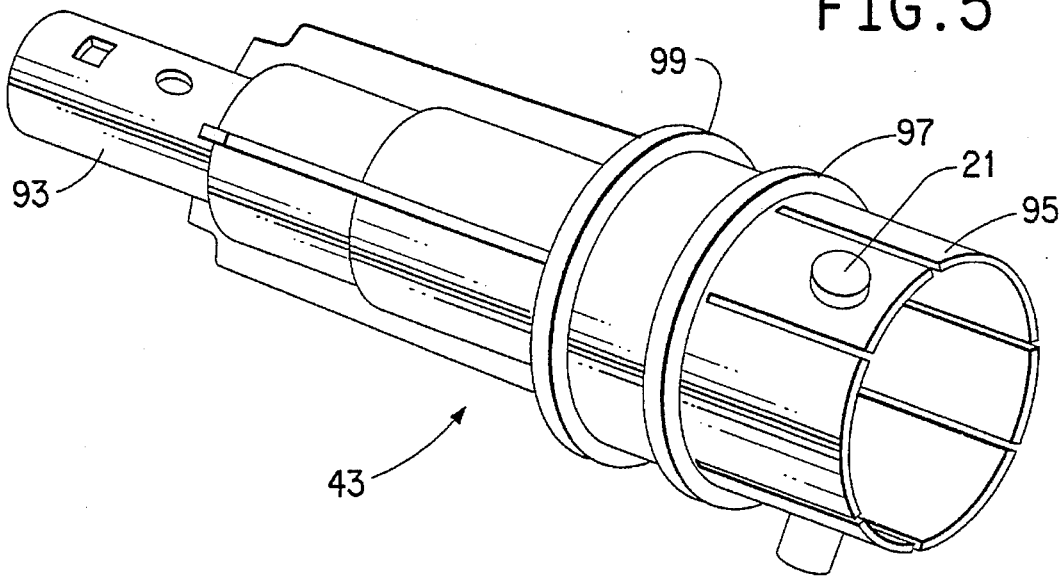
FIG. 5 is a perspective view of a central body. The control stem is mounted within, and slides longitudinally in, the central body.
Figure 6:
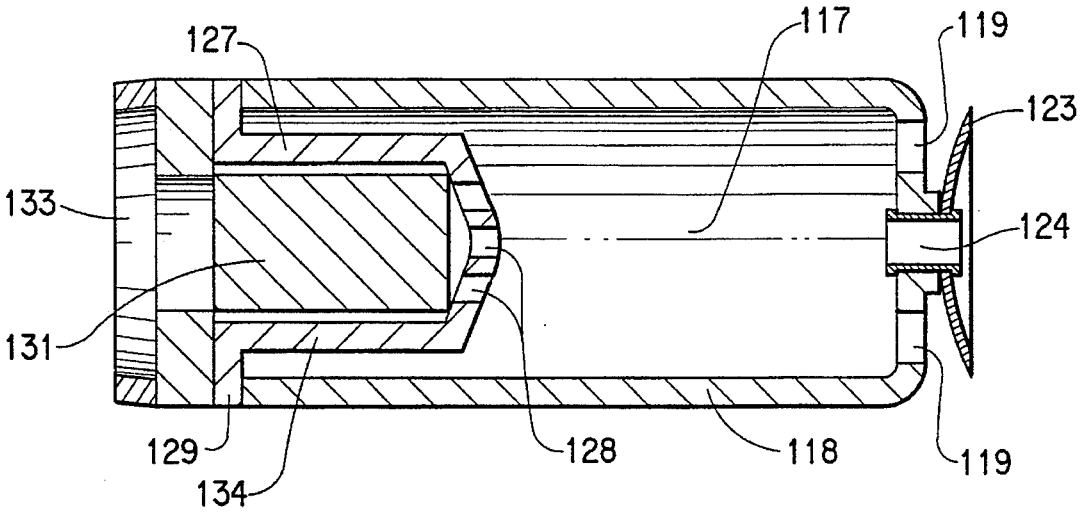
FIG. 6 is a transverse section through the bimetallic temperature control. It shows the normally-open position, when the burner is operating at the desired temperature.
Figure 7:
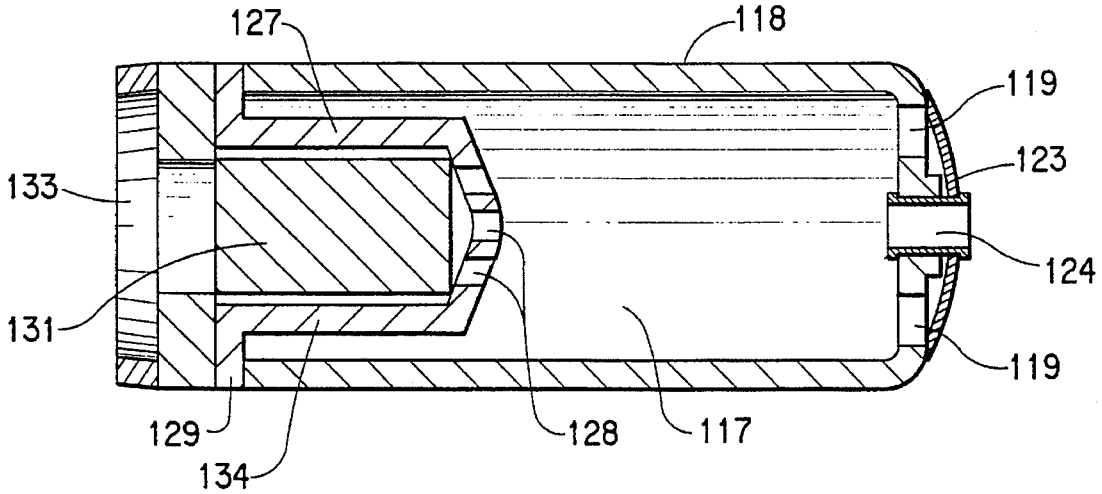
FIG. 7 is a section similar to FIG. 6. It shows the cut-off position, when the temperature is too hot and the flow of gas-air mix is reduced.

Central body 43 (FIG. 5) serves a number of functions. Body 43 provides a cover retaining surface 95 for the cover 17; furnishes the pin 21 for receiving the cover; carries spacers 97 and/or 99 for positioning the central body within outer casing 13; holds valve member 29 in position; holds stem support 77 in position, which, in turn, holds valve seat 81; provides a pivot hole 91 for the spoon pivot for a curling iron; is a seat 75 and shoulder 101 for the diaphragm 87; provides an inner surface 79 to hold alignment members 76 for control stem 45; holds seat 72 for spring 70; and provides barrel retaining surface 93 for barrel 11.

Since this central body 45 serves so many functions and, yet, can be molded as a single integral piece, it reduces the cost of manufacture of the burner of this invention.

The Mixing and Burning Section

Gas leaving outlet orifice 69 at the end of control stem 45 enters Venturi 111. The Venturi action draws air in through bleed hole 113, which mixes with the gas; and the air-gas mixture enters mixing chamber 115 for further mixing. It then enters cylinder 118, which forms a combustion chamber 117, through holes 119.

Catalytic burner 131 is mounted within cylinder 118, has entrance openings 128 to receive the air-gas mix, and contains a catalyst 131. The burner 127 may be of the type described in Roldan et al. U.S. Pat. No. 5,178,530. The gas is combusted in the catalyst, and the products of combustion leave through opening 133 and then through openings in the barrel.

Temperature Control

To control temperature, a round bimetallic eyelet is mounted through central hole 124 which is positioned between holes 119 which connect the two chambers 115 and 117. The eyelet is dimensioned such that its rim is over holes 119.

When the temperature of the unit is in the desired range, or less, the rim does not cover the holes. However, when the temperature is too hot, the eyelet flexes and covers holes 119, preventing flow of the air gas mixture through them. It does not cut all flow, and some of the mixture will still flow through the central hole 124; this remaining flow will be enough to keep the burner operating, but not so much as to keep it at its hot temperature.

Since most of the air-gas mix cannot now reach the catalytic burner 127, it backs up and leaves the unit through bleed hole 113, entering the atmosphere. Once the unit cools sufficiently, the eyelet flexes back, and holes 119 are reopened, returning the unit to normal operation.

In the event of excessive, unsafe overheating, spring seat 72 on the central body fuses, as discussed above, and releases the spring 70. This results in the control stem 45 moving in a direction away from the canister, cutting off gas flow.

Ignition

A piezoelectric ignition system is used for the catalytic burner. It is, however, less expensive than some since it requires only one electrode.

A piezoelectric crystal 141 of the usual type is positioned within barrel 11 at its outer end. It has one electrode 135 facing inwardly and going to the burned gas out 133 of the catalytic burner. Its other electrode is formed by the crystal being in electrical contact, at point 137, with metal barrel 11. The metal frame 124 of burner 127 also makes electrical contact with the barrel 11, at point 129, completing the circuit.

An ignition button 143, spring-pressed outwardly, is positioned at the outer end of the barrel and is used to actuate the crystal 141. When the unit is first turned on, gas will flow and an air-gas mixture will enter the catalytic burner 131, and will leave unburned through outlet 133, since the burner is not at operating temperature initially. Button 143 is pressed, causing a spark between electrode 135 and metal frame 134, igniting the mixture. Once the burner reaches operating temperature, catalytic combustion commences, and the flame goes out.

We claim:

1. A regulating system for controlling the flow of gas, said system including a control section including an elongated control stem and a central body, said control stem having an inlet end and an outlet end, a radial inlet orifice in said control stem proximate to said inlet end, and a longitudinal channel running axially of said control stem connecting said radial inlet orifice with said outlet end, blocking means for blocking said radial inlet orifice, said control stem being mounted within said central body for axial movement within said central body between a position in which said blocking means blocks said radial inlet orifice and a position in which said blocking means does not block said radial inlet orifice, said control stem being spring-pressed to said position in which said blocking means does not block said radial inlet orifice, and pressure-control means controlled by the pressure of flowing gas for moving said control stem to said position in which said blocking means blocks said radial inlet orifice when the pressure exceeds a predetermined value.

2. A pressure control system as set forth in claim 1 in which said blocking means is a valve seat positioned about said control stem proximate to said radial inlet orifice.

3. A pressure control system as set forth in claim 1 including means operatively associated with said control stem to hold said control stem in said position in which said blocking means blocks said radial inlet orifice, thereby providing an "on"-"off" switch for said pressure control system.

4. A pressure control system as set forth in claim 3 in which said means operatively associated with said control stem is a sliding cam transversely mounted in said central body, said sliding cam having a cam shoulder positioned to press against said control stem and move said control stem to said position in which said blocking means blocks said radial inlet orifice.

5. A regulating system for use in controlling the flow of gas from a canister, said regulating system including a canister containing gas, a control section including a central body having a longitudinal axis and a control stem in said central body, said control stem having a control stem axis, said control stem axis being parallel to said longitudinal axis, said control stem having an inlet end and an outlet end, a radial inlet orifice in said control stem proximate to said inlet end and an outlet orifice at said outlet end, and a longitudinal channel running axially of said control stem from said radial inlet orifice to said outlet orifice, said control stem being mounted within said central body for movement within said central body parallel to said longitudinal axis, said control stem being spring-pressed in the direction of said inlet end, means for permitting gas to flow from said canister to said radial inlet orifice, whereby said radial inlet orifice will normally receive gas from said canister and pass it to said longitudinal channel, blocking means for blocking said radial inlet orifice when said control stem is moved in the direction of said outlet end, whereby said radial inlet orifice and said longitudinal channel will be prevented from receiving gas, and pressure control means controlling the axial movement of said stem.

6. A curling iron including a barrel to receive hair to be curled, a heater within said barrel, a housing secured to said barrel, a canister of gas, receiving means to receive and hold said canister of gas within said housing, said receiving means including a probe positioned to hold a valve on said canister open while said canister is held within said housing, a control section including a control stem with a longitudinal axis and a central body, said central body being mounted within said housing and encircling said control stem, holding means for holding said control stem within said control body, said holding means including a control stem support mounted internally of said central body, said holding means permitting movement of said control stem along said longitudinal axis, said holding means including spring means positioned within said control body to press said control stem in an axial direction away from said barrel and toward said canister, said control stem having an internal longitudinal channel running from an outlet at the end of said control stem nearest said barrel to a radial inlet opening proximate to the other end of said control stem, whereby said radial inlet opening will normally receive gas from said canister and pass it through said longitudinal channel to said outlet, blocking means for blocking said radial inlet opening when said control stem is moved in a direction against said spring means, whereby said longitudinal channel will be blocked from receiving gas, a combustion chambers and means for mixing gas exiting from said outlet with air and feeding the resulting mixture to said combustion chamber.

7. A curling iron as set forth in claim 6 including a pressure regulation diaphragm surrounding and secured to said control stem, said diaphragm, said control stem support, and said control body forming a closed plenum, a control opening leading from said longitudinal channel to said plenum, said diaphragm forcing said control stem in a direction against said spring when gas pressure in said plenum exceeds a predetermined value, thereby preventing gas flow through said radial inlet channel.

8. A curling iron as set forth in claim 6 including stop members to limit the extent of axial motion of said control stem.

9. A curling iron as set forth in claim 6 in which said blocking means includes a seat on said control stem proximate to said radial inlet opening, said seat being operatively associated with said radial inlet opening.

10. A regulating system for use in controlling the flow of gas from a canister, said regulation system including a canister containing gas, a control section including a central body having a longitudinal axis and a control stem in said central body, said control stem having a control stem axis, said control stem axis being parallel to said longitudinal axis, said control stem having an inlet end and an outlet end, a radial inlet orifice in said control stem proximate to said inlet end and an outlet orifice at said outlet end, and a longitudinal channel running axially of said control stem from said radial inlet orifice to said outlet orifice, said control stem being mounted within said central body for movement within said central body parallel to said longitudinal axis, said control stem being spring-pressed in the direction of said inlet end, means for permitting gas to flow from said canister to said radial inlet orifice, whereby said radial inlet orifice will normally receive gas from said canister and pass it to said longitudinal channel, blocking means for blocking said radial inlet orifice when said control stem is moved in the direction of said outlet end, whereby said radial inlet orifice and said longitudinal channel will be prevented from receiving gas, a transverse member across said control body, and pressure control means controlling the axial movement of said stem, said pressure control means including a pressure regulation boot secured to said control stem and to said control body, said boot, said transverse member and said control body forming a closed plenum, a radial pressure control orifice leading from said longitudinal channel to said plenum, gas pressure on said boot pressing said control stem in the direction of said outlet end, whereby, when gas pressure exceeds a predetermined value, said control stem is moved in the direction of said outlet end, thereby preventing gas from flowing through said radial inlet orifice.

11. A regulating system for use in controlling the flow of gas from a canister, said regulation system including a canister containing gas, a control section including a central body having a longitudinal axis and a control stem in said central body, said control stem having a control stem axis, said control stem axis being parallel to said longitudinal axis, said control stem having an inlet end and an outlet end, a radial inlet orifice in said control stem proximate to said inlet end and an outlet orifice at said outlet end, and a longitudinal channel running axially of said control stem from said radial inlet orifice to said outlet orifice, said control stem being mounted within said central body for movement within said central body parallel to said longitudinal axis, said control stem being spring-pressed in the direction of said inlet end, means for permitting gas to flow from said canister to said radial inlet orifice, whereby said radial inlet orifice will normally receive gas from said canister and pass it to said longitudinal channel, blocking means for blocking said radial inlet orifice when said control stem is moved in the direction of said outlet end, whereby said radial inlet orifice and said longitudinal channel will be prevented from receiving gas, said blocking means including a valve seat about said control stem proximate to said radial inlet orifice, said valve seat being so positioned as to block said radial inlet orifice or to leave said radial inlet orifice open, depending upon the position of said control stem relative to said valve seat, and pressure control means controlling the axial movement of said stem.

12. A regulating system for use in controlling the flow of gas from a canister, said regulation system including a canister containing gas, a valve on said canister, a control section including a central body having a longitudinal axis and a control stem in said central body, said control stem having a control stem axis, said control stem axis being parallel to said longitudinal axis, said control stem having an inlet end and an outlet end, a radial inlet orifice in said control stem proximate to said inlet end and an outlet orifice at said outlet end, and a longitudinal channel running axially of said control stem from said radial inlet orifice to said outlet orifice, said control stem being mounted within said central body for movement within said central body parallel to said longitudinal axis, said control stem being spring-pressed in the direction of said inlet end, means for permitting gas to flow from said canister to said radial inlet orifice, whereby said radial inlet orifice will normally receive gas from said canister and pass it to said longitudinal channel, blocking means for blocking said radial inlet orifice when said control stem is moved in the direction of said outlet end, whereby said radial inlet orifice and said longitudinal channel will be prevented from receiving gas, receiving means to receive and hold said canister, said receiving means including a probe positioned to hold said valve on said canister open while said canister is held by said receiving means, and pressure control means controlling the axial movement of said stem.

13. A regulating system for use in controlling the flow of gas from a canister, said regulation system including a canister containing gas, a control section including a central body having a longitudinal axis and a control stem in said central body, said control stem having a control stem axis, said control stem axis being parallel to said longitudinal axis, said control stem having an inlet end and an outlet end, a radial inlet orifice in said control stem proximate to said inlet end and an outlet orifice at said outlet end, and a longitudinal channel running axially of said control stem from said radial inlet orifice to said outlet orifice, said control stem being mounted within said central body for movement within said central body parallel to said longitudinal axis, said control stem being spring-pressed in the direction of said inlet end, stop members to limit the extent of axial motion of said control stem, means for permitting gas to flow from said canister to said radial inlet orifice, whereby said radial inlet orifice will normally receive gas from said canister and pass it to said longitudinal channel, blocking means for blocking said radial inlet orifice when said control stem is moved in the direction of said outlet end, whereby said radial inlet orifice and said longitudinal channel will be prevented from receiving gas, and pressure control means controlling the axial movement of said stem.

14. A regulating system for controlling the flow of gas, said system including a control section including an elongated control stem and a central body, said control stem having an inlet end and an outlet end, a radial inlet orifice in said control stem proximate to said inlet end, and a longitudinal channel running axially of said control stem connecting said radial inlet orifice with said outlet end, blocking means for blocking said radial inlet orifice, said control stem being mounted within said central body for axial movement within said central body between a position in which said blocking means blocks said radial inlet orifice and a position in which said blocking means does not block said radial inlet orifice, said control stem being spring-pressed to said "on" position, a transverse member across said control body, and pressure-control means controlled by the pressure of flowing gas for moving said control stem to said position in which said blocking means blocks said radial inlet orifice when the pressure exceeds a predetermined value, said pressure control means including a pressure regulation boot secured to said control stem and said central body, said boot, said transverse member, and said control body forming a closed plenum, a radial pressure control orifice leading from said longitudinal channel to said plenum, said boot being positioned so as to push said control stem in a direction in the direction of said outlet end when gas pressure exceeds a predetermined value, thereby preventing gas flow through said radial inlet orifice.

* * * * *